United States Patent [19]

Napoli et al.

[11] Patent Number: 4,554,789

[45] Date of Patent: Nov. 26, 1985

[54] SEAL COOLING APPARATUS

[75] Inventors: Phillip D. Napoli, Westchester; William R. Patterson, Maineville, both of Ohio

[73] Assignee: General Electric Company, Cincinnati, Ohio

[21] Appl. No.: 594,956

[22] Filed: Apr. 2, 1984

Related U.S. Application Data

[63] Continuation-in-part of Ser. No. 224,877, Jan. 14, 1981, abandoned, which is a continuation-in-part of Ser. No. 15,578, Feb. 26, 1979, abandoned.

[51] Int. Cl.[4] ..... F01D 25/12; F01D 11/04

[52] U.S. Cl. ..... 60/751; 60/39.83; 415/112; 415/176

[58] Field of Search ..... 415/110, 112, 115, 176, 415/180, 111, 116, 175; 416/95; 277/53–56, 75; 60/39.83, 751

[56] References Cited

U.S. PATENT DOCUMENTS

| | | | |
|---|---|---|---|
| 3,291,447 | 12/1966 | Brandon | 415/180 X |
| 3,365,172 | 1/1968 | McDonough et al. | 415/117 |
| 3,826,084 | 7/1974 | Branstrom et al. | 415/115 X |
| 3,989,410 | 11/1976 | Ferrari | 415/115 |
| 4,190,397 | 2/1980 | Schilling et al. | 416/244 A X |
| 4,358,926 | 11/1982 | Smith | 415/115 X |

FOREIGN PATENT DOCUMENTS

| | | | |
|---|---|---|---|
| 0025917 | 2/1977 | Japan | 415/115 |
| 1081158 | 8/1967 | United Kingdom . | |
| 1152331 | 5/1969 | United Kingdom . | |
| 1217807 | 12/1970 | United Kingdom . | |
| 1540353 | 2/1979 | United Kingdom . | |

*Primary Examiner*—Robert E. Garrett
*Assistant Examiner*—H. Edward Li
*Attorney, Agent, or Firm*—Douglas S. Foote; Derek P. Lawrence

[57] ABSTRACT

An improved seal cooling apparatus is provided for use in a gas turbine engine. In a particular embodiment, this apparatus includes means for deriving conditioning air from air discharged from the compressor diffuser and directing this air onto the seal stator to improve its thermal response. The apparatus also includes means to inject a portion of the conditioning air into a cavity forward of the seal to purge the region and prevent zero airflow conditions during engine operation for the purpose of discouraging overheating of a portion of the compressor rotor. A portion of the conditioning air from the cavity is subsequently directed to flow through and thereby cool the seal.

4 Claims, 4 Drawing Figures

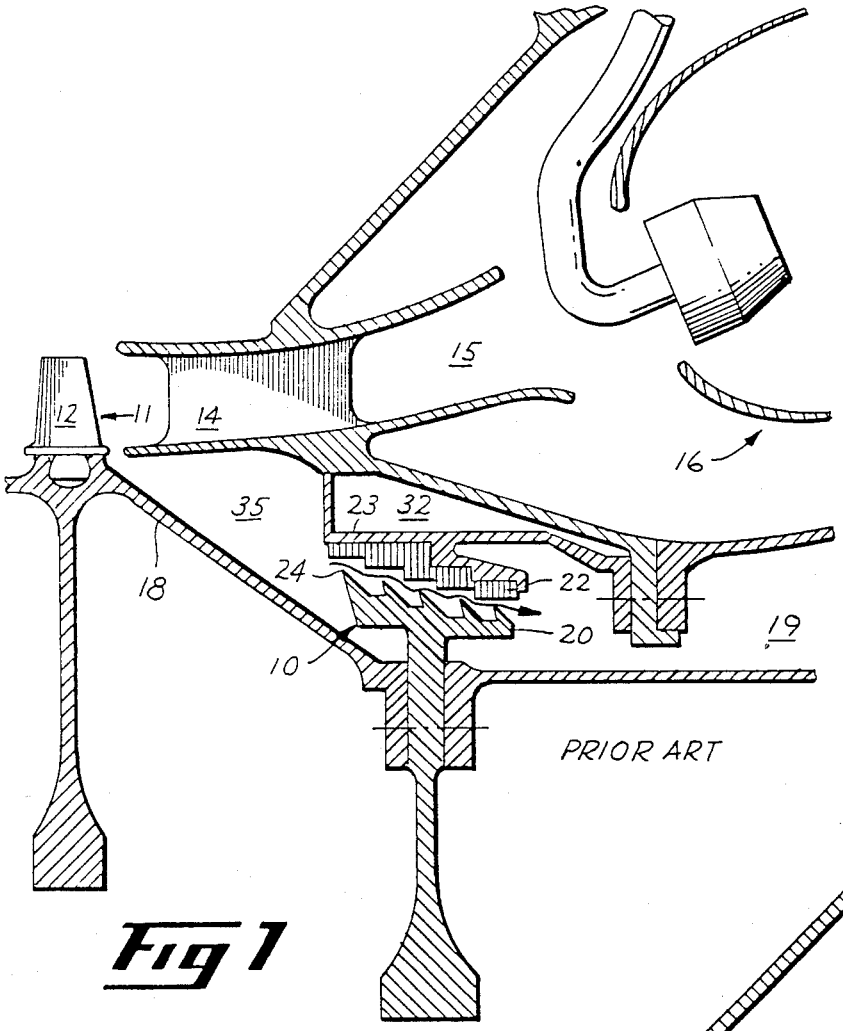
Fig 1
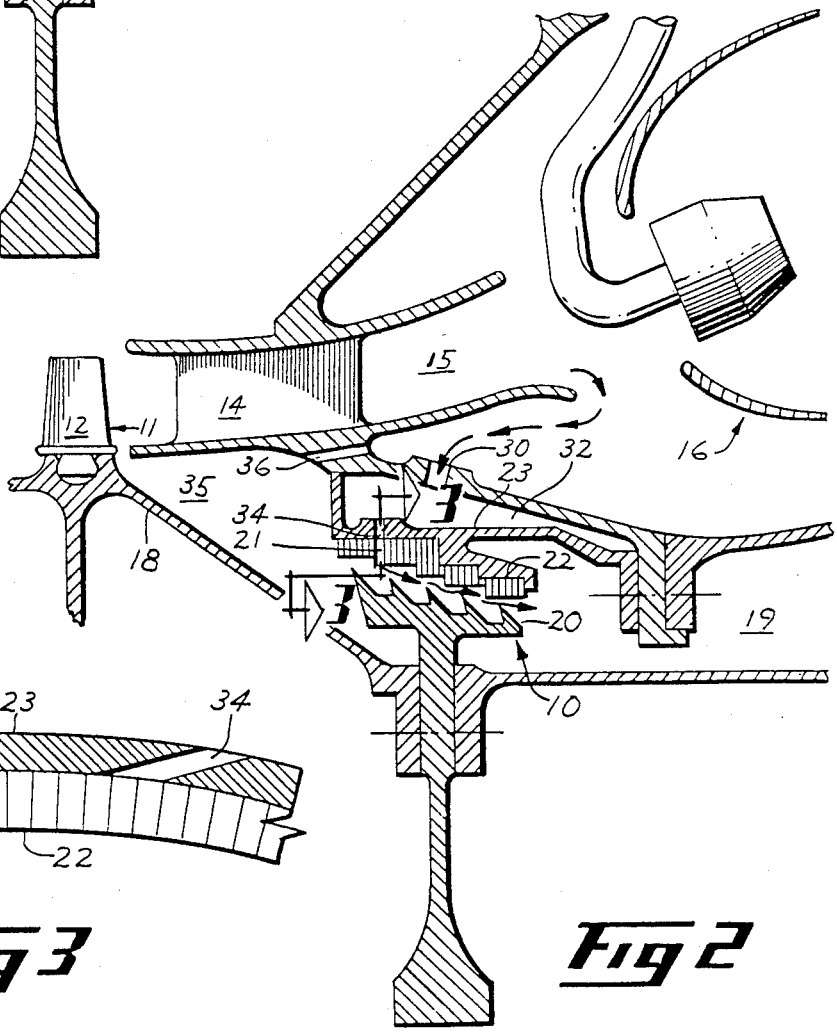
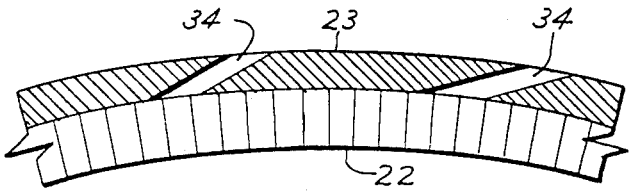
Fig 3
Fig 2

SEAL COOLING APPARATUS

BACKGROUND OF THE INVENTION

The invention herein described was made in the course of or under a contract, or a subcontract thereunder, with the United States Department of the Air Force.

CROSS-REFERENCE TO RELATED APPLICATION

This is a continuation-in-part of Ser. No. 224,877, abandoned, filed Jan. 14, 1981, which is a continuation-in-part of Ser. No. 015,578, filed Feb. 26, 1979, abandoned.

FIELD OF THE INVENTION

This invention pertains to seal cooling structures in gas turbine engines and, more particularly, to seal cooling structures for labyrinth-type seals.

DESCRIPTION OF THE PRIOR ART

A big factor in the performance of a gas turbine engine is the effectiveness of seal structures that must operate over a wide range of operational conditions. In particular, a compressor discharge pressure seal must operate effectively at high pressures and usually at relatively high operating temperatures. The compressor discharge pressure seal is employed to prevent compressed air from leaking between a rotating compressor section of an engine and a nonrotating combustor section. To optimize engine performance, tight clearance on this seal is highly desirable to minimize air leakage. Any air that leaks through the seal does not pass through the combustion cycle of the engine and, therefore, does not contribute to the power produced by the products of combustion.

While preventing excessive air leakage, the compressor discharge pressure seal must also permit relative rotation between upper and lower sections of the seal and must operate in a region of the engine near the compressor discharge outlet where temperatures reach over 1100° F. (593° C.).

Current practice is to employ labyrinth-type seals in this region. A labyrinth-type seal comprises one or more circumferential teeth that are contiguous with a circumferential sealing surface wherein the teeth and sealing surface are relatively rotatable. Labyrinth seals can provide a high restriction to gas flow, and while there is some leakage, labyrinth seals do permit free rotation between upper and lower sections of the seal. This type of seal has many other well known advantages and is widely used at various sealing locations in gas turbine engines.

The effectiveness of labyrinth seals is a function of the clearance between the sealing teeth and the contiguous sealing surface. While engine parts can be accurately machined to obtain minimum clearances and a highly effective seal, practical operation of the engine results in seal clearance degradation due to differential thermal growth between the sealing teeth and the sealing surface. This is recognized, and to some extent alleviated, by widespread use of honeycomb material or other abradable, readily deformable materials to form the sealing surface with which the labyrinth teeth coact. By this approach, if the sealing teeth grow at a faster rate than the sealing surface, the sealing surface wil be deformed without injury to the sealing teeth. This will automatically establish the minimum clearance available when the sealing surface is at its maximum growth position, and the sealing teeth are at their minimum growth position.

To minimize thermal growth, methods and structures have been developed for cooling labyrinth seals by directing cooling air along the outer surface of the sealing structure, as shown in U.S. Pat. No. 3,527,053 assigned to the same assignee as the present invention. Other systems have been developed which directly inject air into the space between the teeth of the labyrinth seal, as shown in U.S. Pat. No. 3,989,410 also assigned to the same assignee as the present invention. The use of cooling air, as disclosed in these systems, greatly improves the efficiency of sealing structures by decreasing thermal expansion, thereby making it possible to maintain tighter seal clearance to cut down on seal leakage.

However, prior art systems involving compressor discharge pressure seals do not fully utilize the cooling air available in the most effective possible manner. In addition, problems have resulted because of friction-induced work done on the cooling air by the rotating portion of the sealing structure in the region where the cooling air is directed against rapidly rotating portions of the seal. This increases the cooling air temperature and, therefore, the seal temperature. Also, in prior art systems, cooling air has been derived from boundary layer air at the base of the last blade of the compressor, and this boundary layer air can be as much as 100° F. (55.5° C.) warmer than nonboundary layer air. Finally, no matter where the cooling air comes from, the flow pattern must circulate through the entire seal and around support structures surrounding the seal. Any regions within the seal or surrounding the seal with zero airflow will undergo insufficient cooling, increasing the risk of material failure due to unnecessarily high temperatures.

SUMMARY OF THE INVENTION

It is, therefore, an object of the present invention to derive the cooling air for the compressor discharge pressure seal from a sufficiently pressurized source with the lowest practical air temperature.

It is another object of the present invention to improve the thermal response of the seal structure for increased seal life and improved efficiency.

It is another object of the present invention to distribute the cooling air in and around the compressor discharge pressure seal with a flow pattern that does not create "dead spots" with zero airflow in the seal or in the surrounding support structures.

These and other objects will be more fully understood from the drawings and from the following description and example, all of which are intended to be representative of rather than in any way limiting on the scope of the present invention.

Briefly, in the apparatus of the present invention, conditioning air for a compressor discharge pressure seal is derived from compressed air discharged from a compressor dump diffuser. Air from this source is the coolest available source of air that is sufficiently compressed for use in this region. This air is cooler than boundary layer air extracted from the base of a compressor blade, as is done in previous compressor seal cooling systems.

The present invention is an improvement in a gas turbine engine comprising a compressor, a compressor diffuser, and a combustor, all in serial flow relation. The engine also includes a pressure seal downstream of the compressor and a cavity forward of the seal in flow communication with compressor discharge air and radially surrounding a portion of a compressor rotor. In addition, the cavity is located upstream of an outlet to the compressor diffuser. The pressure seal includes an outer stator. The improvement comprises means for deriving conditioning air from air discharged from the compressor diffuser and directing that air onto the stator to improve the thermal response of the stator. The invention further includes means to inject a substantially constant portion of the conditioning air into the cavity to purge that region and prevent zero airflow conditions during engine operation for the purpose of discouraging overheating of a portion of the compressor rotor. A portion of the conditioning air from the cavity is directed to flow through and thereby cool the seal.

DESCRIPTION OF THE DRAWINGS

While the specification concludes with claims distinctly claiming and particularly pointing out the invention described herein, it is believed that the invention will be more clearly understood by reference to the discussion below in conjunction with the following drawings:

FIG. 1 is a vertical cross-sectional view of a prior art seal cooling structure;

FIG. 2 is a vertical cross-sectional view of a seal cooling structure of the present invention and the surrounding components of a gas turbine engine;

FIG. 3 is a cross-sectional view of the present invention taken along line 3—3 of FIG. 2.

DESCRIPTION OF THE PREFERRED EMBODIMENT

Figure 4:
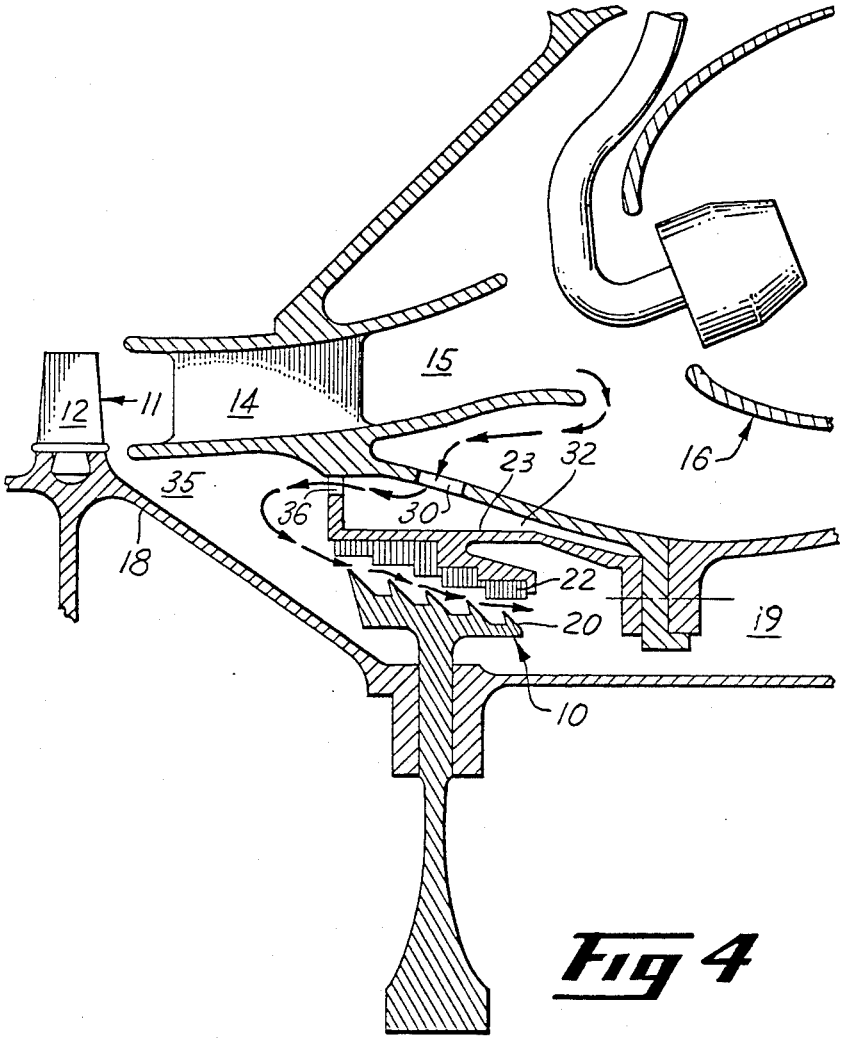
FIG. 4 is a vertical cross-sectional view of an alternate embodiment of the seal cooling structure of the present invention and the surrounding components of a gas turbine engine.

Referring now to FIG. 1, a compressor discharge pressure seal 10 is shown in its usual location within a typical gas turbine engine. This seal 10 is generally located between compressor 11 and a combustor 16 in serial flow relation. In the gas turbine engine, a compressor section compresses engine intake air and a compressor discharge pressure seal retains this compressed air in the thrust-producing flowpath of the engine while permitting relative rotation along this flowpath of compressor parts in relation to the nonrotating combustor 16.

In FIG. 1, an aft compressor blade 12 of the compressor section 11 is shown forward of the compressor discharge seal 10. Intake air is compressed by compressor blades rotating about a central axis of rotation of the turbine engine and then directed through an outlet guide vane 14 and a compressor dump diffuser 15 to diffuse the compressed air and direct the air into the combustor 16. In the combustor section of the engine, the compressed air is combined with fuel and ignited to form a thrust-producing propulsive gas flowstream. For the purpose of simplifying the description of this invention, a complete gas turbine engine is not shown. It is believed that the reader will fully appreciate this invention without a description of an entire engine. If the reader desires an explanation of the operations within a gas turbine engine that affect a compressor discharge pressure seal, the reader is referred to U.S. Pat. No. 3,527,053, the disclosure of which is incorporated herein by reference.

The compressor discharge pressure seal 10 is provided to prevent compressed air from escaping into central regions 19 of the gas turbine engine while, at the same time, permitting rotation of a compressor rotor 18 in respect to the outlet guide vane 14 and combustor 16, which do not rotate. Compressor blades 12, one of which is shown in FIG. 1, are attached to the compressor rotor 18, and the rotor rotates the compressor blades to compress intake air passing through the compressor section 11 of the engine. The outlet guide vane 14 does not rotate and removes a component of rotational velocity of the compressed air before it enters the combustor. The compressor dump diffuser 15 diffuses the air, causing a decrease in flow velocity and an increase in pressure.

The compressor discharge seal 10 is comprised of a series of circumferential labyrinth teeth 20 contiguous with a seal outer stator 22 that defines a sealing surface. Outer edges 24 of the teeth 20 are initially assembled so as to form a very close fit against the stator 22. Upon rotation of the compressor rotor 18 and the attached labyrinth teeth 20 about the engine axis, the outer edges 24 of the teeth create a slight groove in the inner surface of the seal stator 22. The very close fit between the teeth 20 and the seal stator 22 inside these grooves provides a high degree of restriction to gas flow between the rotation teeth 20 and the stationary seal outer stator 22.

An object of this invention is to minimize differential thermal growth between the interacting portions of this labyrinth-type seal and thereby maintain a closer fit between the teeth 20 and the seal stator 22 to improve seal effectiveness under operating conditions.

In prior art systems, such thermal growth has been decreased by passing compressor discharge air between the seal teeth and seal stator to maintain the seal components at lower, more consistent temperatures. In the prior art system shown in FIG. 1, boundary layer air from the compressor discharge at the base of the aft compressor blade 12 is directed radially inward and axially aft along the compressor rotor 18 to the region of the compressor discharge pressure seal 10. Some of the compressed air then leaks through the seal along the path depicted by a wavy arrow, and continues to flow aft into a central region 19 of the gas turbine engine.

An apparatus of the present invention is shown in FIGS. 2 and 3. In FIG. 2, the flowpath of compressed air used to cool the seal structure 10 is shown with multiple arrows. This air first is extracted downstream of the compressor dump diffuser 15. In one embodiment of this invention, air in this region is approximately 100° F. (55.55° C.) cooler than the compressor boundary layer air used in prior art systems, such as the system shown in FIG. 1. The cooling air is directed through inlet holes 30 to a stator cavity 32 radially surrounding the seal stator 22.

A feature of the present invention is the positioning of holes 30 so as to provide impingement cooling to the radially outer surface of stator 22. A difficulty arises during periods of sudden temperature increases, such as when going from engine idle to full power, wherein the centrifugal expansion of rotor 18 occurs faster than the thermal expansion of stator 22. During such periods, the concern is not to cool the stator, but rather to improve its thermal response by heating it more quickly. Thus, during these periods, air passing through inlet holes 30 provides impingement heating of stator 22. In general, therefore, air is conditioning stator 22 by impingement for improved thermal response and closer matching to the growth of rotor 18.

From this stator cavity 32, the air is directed through passages 34 in a seal bracket 23 and across an open slot 21 in the seal stator 22 into the space between the first and second labyrinth teeth 20 of the compressor discharge seal. The first and second teeth are furthest upstream in respect to airflow through the turbine. The passages 34 are uniquely oriented on an angle in respect to a radius from the engine axis to impart a tangential component of velocity in the direction of rotor rotation. The direction of annular orientation is shown in FIG. 3 wherein it can be readily appreciated that the passages 34 cause the cooling air to be injected into the seal in the direction of rotor rotation. The labyrinth teeth 20 are attached to the rotor 18 for rotation therewith. Thus, the labyrinth teeth 20 rotate during engine operation, while the seal stator 22 does not. By orienting the passages 34 on an angle, the cooling air is injected in the direction of rotation of the teeth 20, thereby decreasing the frictional drag between the injected air and the teeth. The tangential component of velocity provided by this form of the present invention reduces the work done by the frictional drag on the cooling air and, therefore, decreases the resulting increase in the temperature of the cooling air. Ultimately, the internal seal structure is maintained at a lower temperature. The pressure of air exiting passages 34 will be essentially the same as or slighly greater than the pressure of air otherwise reaching this point from cavity 35. This is achieved by the metering affect of passages 34.

The cooling air tends to flow through passages 34 because the region downstream of the compressor dump diffuser 15 is at a higher static pressure than the central regions 19 of the gas turbine beyond the compressor discharge seal 10. The cooling air tends to leak in the aft direction across the region between the teeth outer edges 24 and the seal stator 22. A small but continuous flow of leakage air is sufficient to cool the seal components and maintain the internal seal structure at a relatively low temperature. This allows the seal to maintain a closer fit between the outer edges 24 of the seal teeth and seal stator 22 because of diminished thermal expansion and diminished differential thermal growth.

Another unique feature of this invention is the manner in which a seal cavity 35 forward of the compressor discharge seal 10 is purged with air to avoid overheating of the rotor structure 18 as a result of zero throughflow. As can be seen in FIG. 2, an annular series of inlet holes 36, one of which is shown, is provided to inject a small quantity of air into this seal cavity 35. Air will flow in this direction because the static pressure downstream of the diffuser 15 is higher than at the exit of the compressor, upstream of the guide vane 14. These holes 36 can be cut at an angle in respect to an axis of rotation of said compressor rotor to impart a tangential velocity component in the direction of rotor rotation, similar to the manner in which a tangential velocity component is imparted by passages 34. Tangential injection reduces the amount of frictional drag between the injected air and the rotating compressor rotor 18. This reduces the amount of work done on the injected air, the resulting increase in temperature of the air and, consequently, the rotor 18, and minimizes the quantity of air required for cavity purge.

This seal cavity purge apparatus offers another advantage over the previous seal cooling system, shown in FIG. 1, wherein a flow of air is created through the seal cavity 35 because of leakage flow through the compressor discharge pressure seal. In the prior art system, when thermal expansion of the labyrinth teeth 20 of the seal is such as to cause a lesser clearance between the outer edges 24 of the teeth and the seal stator 22, the leakage flow of air is substantially reduced. Cavity 35 flow-through can approach zero, and overheating of the rotor 18 can result. In the present invention, because inlet holes 36 are provided, the amount of air injected into cavity 35 for cavity purge remains relatively constant and is not affected by clearance change in the compressor discharge pressure seal. Therefore, if the seal clearance diminishes causing a temporary drop in seal leakage flow, the seal cavity 35 remains purged, and the affected portions of the rotor 18 do not overheat. The combined effects of the cooling airflow through passages 34 and inlet holes 36 serve to maintain both the compressor rotor 18 and the compressor discharge seal 10 at reasonable temperatures, thereby improving the performance of the high pressure turbine seal and rotor cooling circuit.

Referring now to FIG. 4, an alternate embodiment of the subject invention is shown. In this alternate embodiment, there are no passages in the seal bracket 23 to direct cooling air into a space between labyrinth teeth 20 of the seal. Rather, inlet holes 36 are provided to inject air from stator cavity 32 into seal cavity 35. Thus, conditioning air directed through holes 30 and onto seal bracket 23 of stator 22 will flow in the direction of the seal cavity because the static pressure downstream of the diffuser 15 is higher than at the exit of the compressor. However, the pressure of air exiting inlet holes 36 will be essentially the same as or slightly higher than compressor discharge pressure due to the metering affect of holes 36.

After entering the seal cavity 35, the air will be drawn by normal leakage through the compressor discharge seal 10 thereby cooling the seal. In addition, a small amount of air will be drawn back into the region just upstream of the guide vane 14. Therefore, even if the seal 10 seals perfectly preventing any leakage flow through the seal, the seal cavity 35 will remain purged so as to discourage overheating of the rotor structure 18.

Thus, conditioning air derived from air discharged from the compressor diffuser comes in contact with both the radially outer and inner surfaces of stator 22. In this manner, maximum advantage of the conditioning air is achieved. In addition, this same air purges seal cavity 35 in a manner described above.

While specific embodiments of the present invention have been described, it will be apparent to those skilled in the art that various modifications thereto can be made without departing from the scope of the invention as recited in the appended claims. For example, while the invention has been described in conjunction with a labyrinth-type compressor discharge pressure seal in a gas turbine engine, it will be appreciated that various aspects of this invention are applicable to other sealing regions in a gas turbine engine and can be applied to sealing structures other than labyrinth-type seals. The apparatus of the present invention can be used to increase the performance of various seals in any type of turbomachinery. The scope of the invention, therefore, is to be derived from the following claims.

Having described the invention, what is claimed as novel and desired to be secured by Letters Patent of the United States is:

1. An improved gas turbine engine comprising a compressor, a compressor diffuser, and a combustor all in serial flow relation, a pressure seal downstream of said compressor and a cavity forward of said seal in flow communication with compressor discharge air and radially surrounding a portion of a compressor rotor, said cavity being located upstream of an outlet to said compressor diffuser, said pressure seal including an outer stator, wherein the improvement comprises:

means for deriving conditioning air from air discharged from the compressor diffuser and directing said conditioning air onto said stator to improve the thermal response of said stator; and means to inject a substantially constant portion of said conditioning air into said cavity to purge the region and prevent zero airflow conditions during engine operation for the purpose of discouraging overheating of a portion of the compressor rotor;

wherein a portion of said conditioning air from said cavity is directed to flow through and thereby cool said seal.

2. An improved gas turbine engine comprising a compressor, a compressor diffuser, and a combustor all in serial flow relation, a pressure seal downstream of said compressor and a seal cavity forward of said seal in flow communication with compressor discharge air and radially surrounding a portion of a compressor rotor, said cavity being located upstream of an outlet to said compressor diffuser, said pressure seal including an outer stator and stator cavity radially surrounding said stator, wherein the improvement comprises:

means for deriving conditioning air from air discharged from the compressor diffuser and directing said conditioning air into said stator cavity and onto said stator to improve the thermal response of said stator; and means to inject a substantially constant portion of said conditioning air into said cavity to purge the region and prevent zero air flow conditions during engine operation for the purpose of discouraging overheating of a portion of the compressor rotor;

wherein a portion of said conditioning air from said cavity is directed to flow through and thereby cool said seal.

3. The gas turbine engine as recited in claim 2 wherein said means to inject a substantially constant portion of said conditioning air into said seal cavity comprises a distinct passage connecting said stator cavity with said seal cavity.

4. The gas turbine engine recited in claim 3 wherein said passage is oriented at an angle in respect to an axis of rotation of said compressor rotor to impart a tangential velocity component in the direction of compressor rotor rotation.

* * * * *